US008003033B2

(12) United States Patent
Elgebrant

(10) Patent No.: US 8,003,033 B2
(45) Date of Patent: Aug. 23, 2011

(54) METHOD OF PRODUCING A PACKAGING CONTAINER

(75) Inventor: Johan Elgebrant, Helsingborg (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 12/578,938

(22) Filed: Oct. 14, 2009

(65) Prior Publication Data

US 2010/0029452 A1 Feb. 4, 2010

Related U.S. Application Data

(62) Division of application No. 10/574,959, filed as application No. PCT/SE2004/001362 on Sep. 22, 2004.

(30) Foreign Application Priority Data

Oct. 8, 2003 (SE) ..... 0302668

(51) Int. Cl.
*B29C 45/14* (2006.01)

(52) U.S. Cl. ..... 264/252; 264/257; 264/275

(58) Field of Classification Search ..... None
See application file for complete search history.

(56) References Cited

U.S. PATENT DOCUMENTS

| | | | | | |
|---|---|---|---|---|---|
| 1,312,581 | A | | 8/1919 | Schmitt | |
| 2,105,798 | A | | 1/1938 | Tobiasson | |
| 3,159,303 | A | * | 12/1964 | Betner | 220/270 |
| 3,204,805 | A | | 9/1965 | May | |
| 4,434,908 | A | * | 3/1984 | French | 220/276 |
| 4,548,333 | A | * | 10/1985 | Kobayashi et al. | 220/276 |
| 4,564,139 | A | * | 1/1986 | Reil | 229/5.5 |
| 4,756,443 | A | * | 7/1988 | Murayama | 220/270 |
| 4,934,585 | A | * | 6/1990 | Reil | 229/106 |
| 4,942,974 | A | | 7/1990 | Larrison | |
| 4,955,500 | A | | 9/1990 | Rhoads | |
| 4,966,301 | A | * | 10/1990 | Yamashita et al. | 220/270 |
| 5,025,981 | A | | 6/1991 | Schellenberg | |
| 5,114,507 | A | * | 5/1992 | Piltz et al. | 156/69 |
| 5,125,528 | A | * | 6/1992 | Heyn et al. | 220/269 |
| 5,139,163 | A | | 8/1992 | Diaz | |

(Continued)

FOREIGN PATENT DOCUMENTS

DE 87 17 153.8 U1 6/1988

(Continued)

OTHER PUBLICATIONS

English-language translation of Japanese Office Action dated Sep. 9, 2008 issued in the corresponding Japanese Patent Application No. 2006-532223.

(Continued)

*Primary Examiner* — Edmund H. Lee
(74) *Attorney, Agent, or Firm* — Buchanan Ingersoll & Rooney PC

(57) ABSTRACT

The present invention relates to a packaging container (11) comprising a first portion (13) formed of a first material or material combination, a second portion (12) formed of a second material or material combination, and a pouring opening (14) formed in said first portion (13), characterized in that the first portion (13) is further provided with a tearing line (16*a-c*) extending essentially from the pouring opening (14) towards the interface between the first portion (13) and the second portion (12) and essentially along the complete extension of said interface.

9 Claims, 2 Drawing Sheets

U.S. PATENT DOCUMENTS

| | | | | | |
|---|---|---|---|---|---|
| 5,156,295 | A | | 10/1992 | Gordon et al. | |
| 5,300,748 | A | | 4/1994 | Colombo | |
| 5,353,943 | A | * | 10/1994 | Hayward | 220/276 |
| 5,398,843 | A | | 3/1995 | Warden et al. | |
| 5,626,250 | A | | 5/1997 | Dorazio | |
| 5,688,544 | A | | 11/1997 | Bolton et al. | |
| 5,769,277 | A | | 6/1998 | Elliott | |
| 5,830,398 | A | * | 11/1998 | Heyn et al. | 264/154 |
| 5,900,086 | A | | 5/1999 | Keller | |
| 5,904,259 | A | | 5/1999 | Hidding et al. | |
| 6,116,441 | A | | 9/2000 | Decelles et al. | |
| 6,655,553 | B2 | | 12/2003 | Staniszewski et al. | |
| 7,137,523 | B2 | * | 11/2006 | Holm et al. | 220/258.2 |
| 2003/0071042 | A1 | | 4/2003 | Adams | |

FOREIGN PATENT DOCUMENTS

| | | | |
|---|---|---|---|
| DE | 43 03 216 | A1 | 8/1994 |
| EP | 0 108 166 | A1 | 5/1984 |
| EP | 0358083 | A2 | 3/1990 |
| EP | 0 849 185 | A2 | 6/1998 |
| EP | 1 103 478 | A1 | 5/2001 |
| JP | 02-180138 | A | 7/1990 |
| JP | 06-32352 | U | 4/1994 |
| JP | 09-290852 | A | 11/1997 |
| JP | 2001-114325 | A | 4/2001 |
| JP | 2007008532 | * | 1/2007 |
| RU | 2154005 | C2 | 8/2000 |
| WO | WO 02/070365 | * | 9/2002 |
| WO | WO 02/070365 | A1 | 9/2002 |

OTHER PUBLICATIONS

Russian Office Action dated Mar. 26, 2008 issued in the corresponding Russian Patent Application No. 2006115618/12(016955).

Indian Office Action dated Jan. 24, 2011 issued in the corresponding Indian Patent Application No. 1171/CHENP/2006.

* cited by examiner

METHOD OF PRODUCING A PACKAGING CONTAINER

This application is a divisional application of U.S. patent application Ser. No. 10/574,959 filed on Apr. 7, 2006, still pending which is a U.S. National Stage filing of International Patent Application No. PCT/SE2004/001362 filed on Sep. 22, 2004, the entire contents of each of which is incorporated by reference herein, and claims priority to Swedish Patent Application No. 0302668-9 filed on Oct. 8, 2003, the entire contents of which is incorporated by reference herein.

FIELD OF INVENTION

The present invention relates to a packaging container comprising a first portion essentially being formed of a first material and a second portion essentially being formed of a second material. The present invention also relates to a method of producing a packaging container of this kind.

TECHNICAL BACKGROUND

Packaging containers comprising a first portion essentially being formed of a first material and a second portion essentially being formed of a second material have been known for a long time. One example of such a packaging container is shown in EP-A1-108166. Another example of such a packaging container is disclosed in WO 02/070365 A1. The latter one is a commercially available packaging container marketed by Tetra Pak under the trademark Tetra Top.

The packaging container is manufactured in accordance with the following steps:

a) a roll of a packaging laminate is cut into sheets, b) the sheets are formed into sleeves by sealing two edges to each other, c) the sleeves are slid onto a mandrel on a mandrel wheel, d) a top made of a plastic material is injection moulded onto one end of the sleeve, e) the container is ejected (standing on its top) from the moulding station to a filling station, f) the container is filled with a product, g) the bottom is formed by squeezing the open end and sealing the edge into a transversal seal, and i) the bottom is finally formed by folding flaps and sealing the flaps to the bottom surface of the bottom.

As described in WO 02/070365 A1, the container thus formed is usually provided with a closed top, being adapted to be opened by removal of a membrane covering the pouring opening. In order to facilitate the opening of the container, the transition between the membrane and the surrounding portions of the top is formed as a weakening line, i.e. a portion having a smaller wall thickness than the surrounding portions.

One advantage with making the packaging container of different materials or material combinations in different portions of the container is that the different portions can be adapted to any desired property being important for respective portion of the package. It is for instance common that a neck on a packaging container has a well-defined shape in order to be able to correctly receive a screw cap or some other kind of opening device and in co-operation with the cap form a tight joint. Preferably, this is achieved using some kind of plastic material for the neck. Furthermore, it is also common that the packaging container is required to have some barrier properties, such as light, taste or oxygen barrier. A plastic material with these properties is more costly than a plastic material without these properties. In such a case is it advantageous to use fibre based packaging laminate with barrier properties. This packaging laminate is a typical example of a portion of the container made of a material combination, the laminate typically comprises a paper or fibre-based layer and one or more plastic layers. In many cases the laminate also comprises an aluminium layer.

There are a number of different reasons to use such multi-material packages where different portions of the packages are formed of different materials or material combinations. It can e.g. facilitate process, manufacture and transport of different materials. Moreover, the overall appearance of the packaging container is most often more attractive if a packaging laminate forming the package is directly provided with the desired print than if a plastic container is provided with a separate label. Furthermore, fibre based packaging laminates can be transported as rolls, or in crates as flat folded blanks, compared to plastic containers being transported as ready made or as preforms which requires a significantly greater transported volume in comparison to the filled volume in the finished containers.

In some cases there is, however, some drawbacks with containers made of separate materials. When the container has been used and is returned for disposal or some other kind of waste management, this subsequent handling may require that the portions formed of different materials or material combinations are separated from each other. It is for instance common that the waste is sorted into the fractions plastic, paper, metal and glass, i.e. a glass jaw and its metallic lid are to be separated from each other in connection with the waste management. Since this jaw and lid are separate members it is simple and obvious for a consumer that the members made of different materials are to be sorted into different fractions. When the packaging container body itself is made of different materials it becomes trickier. If the separation of the different materials cannot be made in a satisfactory manner, the reuse or recycling cannot be realized and the waste must be burned or deposited. In many cases the waste is nevertheless burned, but also in such a case it might be desirable with a preceding separation since the burning of the waste can be controlled by selectively adding different amounts of the different material fractions over time.

Lately, environmental demands from consumers and authorities have put more pressure on companies producing packaging containers to make a packaging container with the above-mentioned benefits and still being disposable in accordance with waste management systems.

SUMMARY OF INVENTION

It is thus an object of the invention to make a packaging container which in a simple manner can be sorted into different fractions in connection with the ultimate disposal, reuse or recycling.

In the recycling system of today a significant portion of the responsibility is put on the consumer, and consequently another object of the invention is to make a container which can be separated by the consumer already at the point where the consumer throw away the emptied container.

It is also an object with the invention to keep the above-mentioned advantages with a container made of different materials to greatest possible extent.

The above mentioned objects have in accordance with the invention been achieved with a packaging container as defined by way of introduction, which has been given the characterising features that the first portion is further provided with a tearing line extending essentially from the pouring opening towards the interface between the first portion and the second portion and essentially along the complete extension of said interface.

By providing the container with this tearing line it will easy to separate the two portions from each other. Since the tearing line starts from the pouring opening it will start from a point where a crack will start only in one direction (towards the interface) which will give a distinct feed-back to the consumer tearing the container apart. Moreover, by starting in a point at an open end, the force needed (since the energy will only be directed into one crack propagation direction) will not be to high to cause any doubts to the consumer whether the tearing has been started correctly or not. Moreover, in most cases the pouring opening will be at the top of the package and the interface will be somewhat below and extend more or less horizontally around the container, which in both cases will lead to a situation where the desired tearing direction will be transversal to any load from packages above during transport, i.e. in most cases the claimed feature will lead to a design being easy to tear but still being strong when it comes to resistance against distribution damage.

Preferred embodiments of the packaging container are defined in the dependent claims.

In accordance with a preferred embodiment the first portion of the container is generally formed of a plastic material. By using a plastic material (having a uniform material or a number of layers) it is e.g. possible to form a transparent portion and/or a portion having a neck with threads and/or a portion having a rather complex shape.

In accordance with a preferred embodiment the second portion of the container is generally formed of fibre based packaging laminate. Using a fibre based laminate is convenient when it comes to making a container body provided with a printed design on it. Moreover, the laminate can readily be closed and folded to form a tight bottom.

Preferably, the tear line is defined by a weakening line extending essentially from the pouring opening towards the interface between the first portion and the second portion and essentially along the complete extension of said interface. This is a distinct and readily achievable manner of providing the container with a tear line. An inferior material thickness is a simple but still functional manner of making the tear line.

In accordance with a preferred embodiment the first portion of the container is formed by injection moulding of a plastic material into a mould. This way the first portion can be provided with a weakening line, formed into a complex shape, and be provided with a membrane covering the pouring opening all in one forming station.

Preferably, a connection is formed in the interface between the first portion and the second portion by fusing a plastic layer of the second portion together with the injection moulded plastic material. By using the heat from the injection moulding process the heated, more or less flowable plastic material will fuse together will a plastic layer of the second portion. This way a tight joint between the first and second portion is made in readily manner.

Preferably, the weakening line is a portion of smaller wall thickness than surrounding portions, the inferior wall thickness being formed by a grove on the outside of the first portion. This design is convenient to use e.g. when the first portion is made of plastic material being extrusion blow moulded. Since the shape of the object being blow moulded is determined by the shape of the outside tool against which the extruded plastic material is blown, a distinct shape is preferably designed to be formed on the outside of the plastic object.

In accordance with a preferred embodiment the weakening line is a portion of smaller wall thickness than surrounding portions, the inferior wall thickness being formed along the portion of the weakening line extending from the pouring opening to the interface by a grove on the inside of the first portion, and along the interface by a grove on the outside of the first portion. This design is preferred to use when the first portion is injection moulded using a system with a single inner tool and a dividable outer tool. Since the inner tool must be removable the diameter of the inner tool must be ever decreasing and therefore it will be tricky to form a groove on the inside along the interface, which corresponds to an outwardly directed bulge on the inner tool. However, the interface can be provided with an inwardly directed groove on the outside without negatively effecting the appearance or functionality of the container, since the in any case is a transition between the two portions. In most cases the pouring opening is provided in the top of a container, whereby the weakening line extending from the pouring opening to the interface will extend in the same direction as the release direction of the inner tool. This makes it possible to form the inner groove using an outwardly directed bulge on the inner tool. In many cases this portion of the weakening line is preferably formed on the inside of the container since it otherwise might negatively effect the appearance of the container, since there in many cases are not any reason for any transition at this portion of the container.

In accordance with a preferred embodiment the pouring opening is shaped such that a pull tab is formed on either side of the point where the tear line intersect the edge of the pouring opening. By forming the opening with a portion extending inwardly over the opening, a pull tag is readily formed. The pull-tab is formed as a distinct change of curvature of the edge of the opening in the vicinity of the intersection between the tear line and the edge of the opening. The opening can of course be provided with such a pull-tab on one or both sides in relation to the intersection. By forming the opening with such a pull-tab, the consumer will on one hand be informed about how to achieve the separation, and on the other hand automatically put a shearing force in action directly at the starting point of the tear line.

The above-mentioned objects have in accordance with the invention also been achieved with a method comprising the steps of:

a) providing a sleeve of a second material or material combination, b) injection moulding a first portion formed of a first material or material combination onto the sleeve, whereby the first portion is formed with a weakening line extending essentially from the pouring opening towards the interface between the first portion and the second portion and essentially along the complete extension of said interface. This way a container made of a fibre based laminate and a plastic top can be readily made. Moreover, since the top portion is provided with a tear line the consumer can readily separate the container into different fractions at the ultimate disposal.

Preferred embodiments of the method are defined in the dependent claims.

BRIEF DESCRIPTION OF THE DRAWINGS

The invention will be described in more detail with reference to the appended schematic drawings, which shows an example of a presently preferred embodiment of the invention.

DETAILED DESCRIPTION OF A PREFERRED EMBODIMENT

Figure 3:
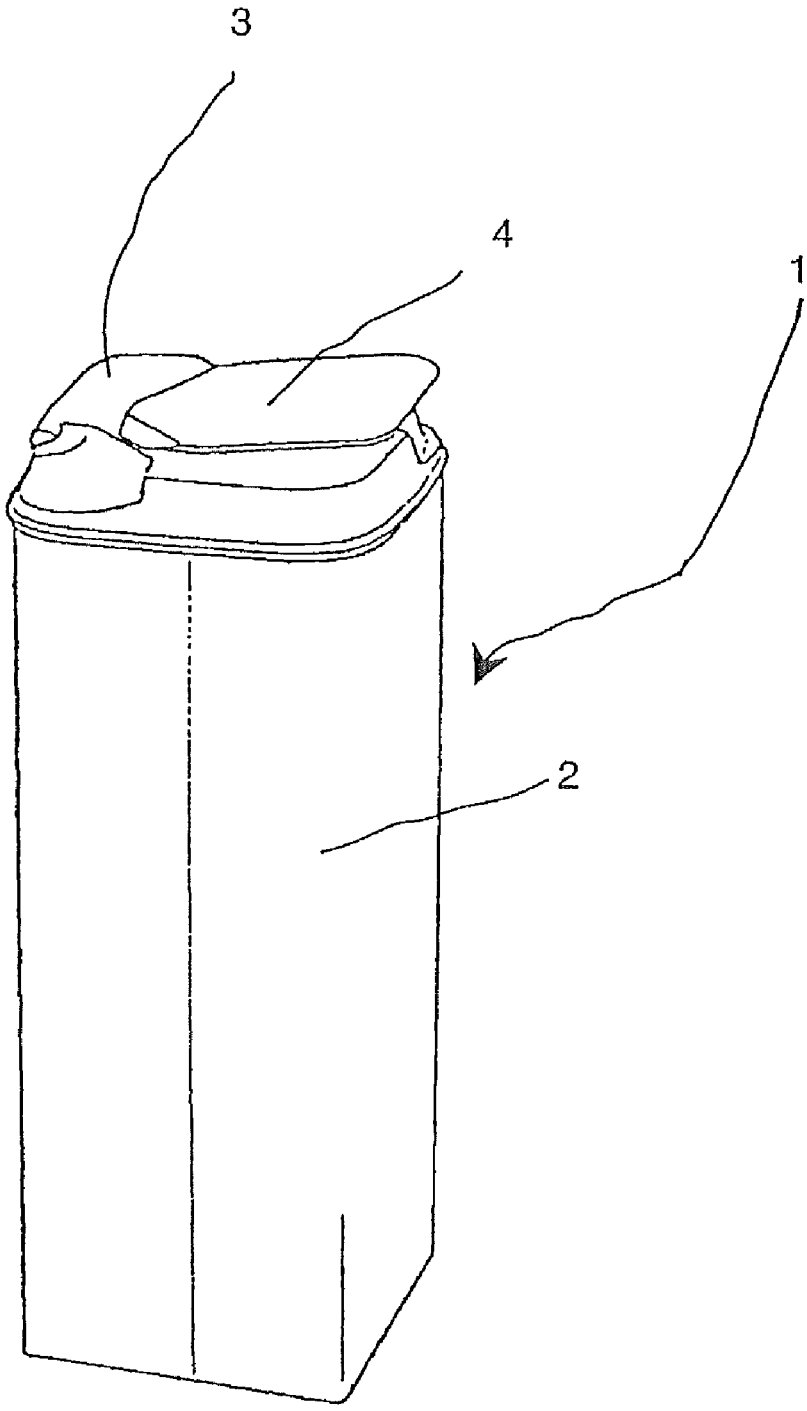
Fig 3 PRIOR ART
FIG. 3 shows an example of a container that can be provided with the inventive separation feature. The container shown in FIG. 3 has its lid still in place closing the pouring opening.

FIG. 3 discloses a container 1 having a sleeve 2 made of a fibre based packaging laminate and a top 3 made of a plastic material. The container 1 is made using the method mentioned in the introductory portion of the disclosure, where a sleeve 2 is put on a mandrel and a top 3 is injection moulded directly onto the sleeve 2. The top 3 is provided with a lid 4 being adapted to be removed (partly or completely) by tearing it off along a weakening line. Such a weakening line is in detailed described in WO 02/070365 A1 and will not be described in any detail in this disclosure. Reference is made to WO 02/070365 A1 for a deeper understanding of this commercially available container.

Figure 1:
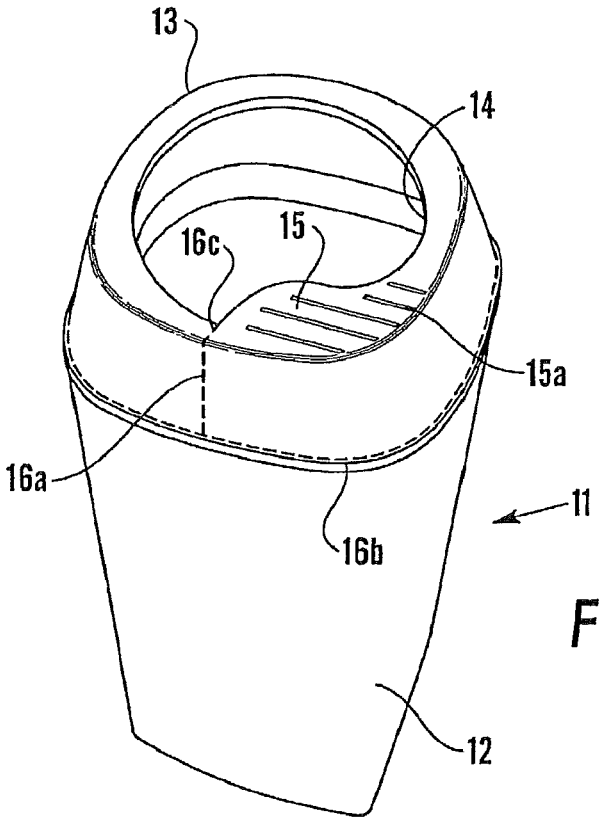
FIG. 1 shows a container where the lid has been removed and the pouring opening is exposed.

FIG. 1 discloses the appearance of the inventive container 11 when the lid has been removed from a container 11. The opening 14 is provided with a portion with decreased radius, thus forming a pull-tab 15. This pull-tab 15 connects with the surrounding portion of the edge 14 of the opening at an angle close to 90°.

The top 13 is further provided with a weakening line 16 having a first portion 16*a* extending from the opening 14 towards the interface between the top 13 and the sleeve 12 and a second portion 16*b* extending along the interface. In the disclosed design the top 13 is provided with a flange extending around the opening 14, whereby a third portion 16*c* of the weakening line extends across this flange. The weakening line 16 is formed as a thin line having a smaller wall thickness than surrounding portions. In the disclosed case the weakening line 16 has a wall thickness of about 0.3 mm and the surrounding portions has a wall thickness of about 0.6 mm. In order to make it easy to tear the first portion 13 along the weakening lines 16, the weakening lines 16 have a cross-section formed with a least one relatively sharp corner acting as a notch for the tear propagation. Considering only package performance would e.g. give that a V-shaped groove would make tearing easy. However, considering also lifetime of the moulding tools give that a rectangular cross-section with sharp corners at the bottom of the groove will make tearing easy and will give a satisfactory lifetime of the moulding tools. The first 16*a* and third 16*c* portions of the weakening line 16 is formed by providing the top 13 with a groove on the inside of the container 11. The second portion 16*b* of the weakening line 16 is formed by providing the top 13 with a groove on the outside of the container 11. This configuration is adapted to make a container 11 by injection moulding of the top 13.

When the consumer has emptied the container 11, he/she grabs the container body 12 with its left hand and the pull tab 15 with the thumb on the outside and the index finger on the inside of the pull tab 15. The right hand is then pulled upwards and slightly turned counter clock wise thus imparting a significant shear stress to the top 13 along the first portion 16*a* of the tear line 16. Since the pull tab 15 connects with the opening edge 14 at an angle the transition between the pull-tab 15 and the rest of the opening edge 14 will act as a notch thus initiating the crack propagation.

Figure 2:
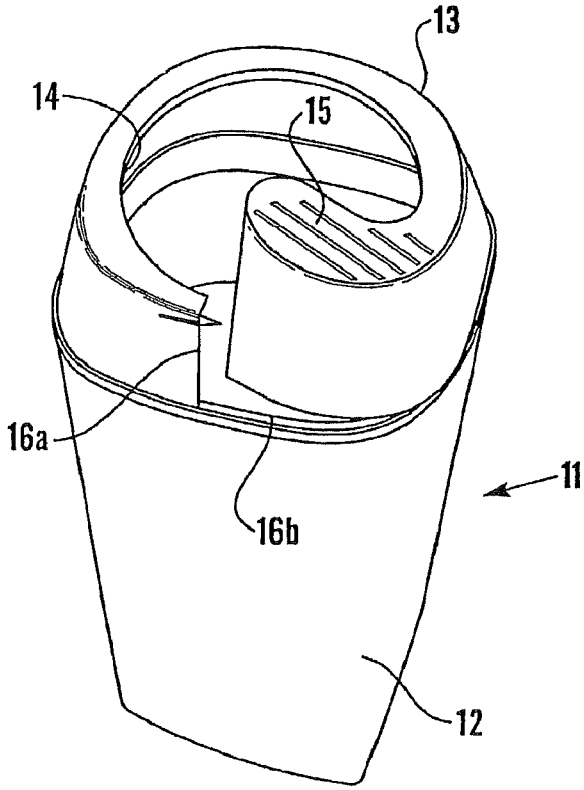
FIG. 2 shows a container where the removal of the top portions has been initiated.

The portion of the top 13 having the pull-tab 15 will be pulled outwardly until the crack has propagated to the interface between the top 13 and the sleeve 12. Thereafter the portion with the pull-tab 15 will be torn around the container 11 as the crack propagates along the weakening line 16*b* extending along the interface. In order to show the different portions of the container, the pull-tab 15 is in FIG. 2 shown in a state where it is pressed inwardly.

At the point where the crack turns from the first direction 16*a* to the second direction 16*b*, the location changes from being on the inside to being on the outside. The consumer will thus feel a slight increase in pulling force needed, but since the complete side of the container top 13 act as pull tab the consumer will have a natural movement and a strong grip acting in favour of the desired crack propagation direction.

In order to facilitate the tearing off of the top portion 13, the pull-tab 15 is provided with grooves 15*a*.

One example of a packaging laminate suitable for the use in a container of the described kind comprise from the inside out; a plastic layer of polyethylene, a paper layer and an outer layer of polyethylene. In some cases an aluminium layer and an additional polyethylene layer is placed between the inside of the paper layer and the inside polyethylene layer. Of course different plastic materials can be used. It is also common knowledge to add different layers of binder layers.

One example of a plastic material suitable for use in the top of the container of the described kind is polyethylene with different kinds of pigment to the get the desired colouring. One advantage with using the same basic plastic in the plastic layers of the laminate and in the top is that they will fuse together.

It is contemplated that there are numerous modifications of the embodiments described herein, which are still within the scope of the invention as defined by the appended claims.

For instance the grooves making the weakening lines can be formed on the outside. This is especially appropriate when using extrusion blow moulded plastic tops on the container.

Further, for instance the pouring opening can be provided with threads for a screw cap.

Furthermore, the tear line in the form of the weaking line portions 16*a* and 16*b* are shown in the example as being angled to each other. However, the scope of protection is not limited to such embodiment. Another alternative is to provide a first portion 16*a* of the weakening line beginning at the opening and extending in the form of for example an arc having an end substantially tangential to the second portion 16*b* of the weaking line. That is, the first portion will smoothly be connected to the second portion.

The invention claimed is:

1. Method of producing a packaging container comprising a first portion formed of a first material or material combination and a second portion formed of a second material or material combination, said first portion including a free edge defining a pouring opening, the method comprising:

providing the second portion in the form of a sleeve, injection moulding the first portion onto the sleeve, whereby the first portion is formed with a weakening line extending essentially from the pouring opening towards an interface between the first portion and the sleeve and essentially along an entirety of said interface.

2. Method according to claim 1, wherein the weakening line is formed as a portion of smaller wall thickness than surrounding portions, with an inferior wall thickness being formed along the portion of the weakening line extending from the pouring opening to the interface by a groove on the inside of the first portion, and along the interface by a groove on the outside of the first portion.

3. Method according to claim 1, wherein the first portion of the container is formed of a plastic material.

4. Method according to claim 1, wherein the second portion of the container is formed of fibre based packaging laminate.

5. Method of producing a packaging container comprising a first portion formed of a first material or material combination and a second portion formed of a second material or material combination different from the first material or material combination, and a pouring opening formed in said first portion, the method comprising:

providing the second portion in the form of a sleeve, injection moulding the first portion onto the sleeve, whereby the first portion is formed with a weakening line extending essentially from the pouring opening towards an interface between the first portion and the sleeve and essentially along an entirety of said interface.

6. Method according to claim 5, wherein the weakening line is formed as a portion of smaller wall thickness than surrounding portions, with an inferior wall thickness being formed along the portion of the weakening line extending from the pouring opening to the interface by a groove on the inside of the first portion, and along the interface by a groove on the outside of the first portion.

7. Method according to claim 5, wherein the first portion of the container is formed of a plastic material.

8. Method according to claim 5, wherein the second portion of the container is formed of fibre based packaging laminate.

9. Method of producing a packaging container comprising a first portion formed of a first material or material combination, a second portion formed of a second material or material combination, and a lid provided on the first portion and configured to be at least partially removed from the first portion so that a free edge of the first portion is exposed and defines a pouring opening in the first portion, the method comprising:

providing the second portion in the form of a sleeve, injection moulding the first portion onto the sleeve, whereby the first portion is formed with a weakening line extending essentially from a part of the first portion which is exposed as the free edge when the lid is at least partially removed towards an interface between the first portion and the sleeve, the weakening line also extending essentially along an entirety of said interface.

* * * * *